US005613717A

United States Patent [19]

Ha

[11] Patent Number: 5,613,717

[45] Date of Patent: Mar. 25, 1997

[54] DOOR LOCKING DEVICE FOR VEHICLE

[75] Inventor: Changki Ha, Kyungsangnam-do, Rep. of Korea

[73] Assignee: Hyundai Motor Company, Rep. of Korea

[21] Appl. No.: 580,157

[22] Filed: Dec. 28, 1995

[30] Foreign Application Priority Data

Dec. 30, 1994 [KR] Rep. of Korea ..... 94-39719

[51] Int. Cl.[6] ..... E05B 3/00

[52] U.S. Cl. ..... 292/336.3

[58] Field of Search ..... 292/336.3, DIG. 31, 292/DIG. 62, 196

[56] References Cited

U.S. PATENT DOCUMENTS

| | | | |
|---|---|---|---|
| 4,838,590 | 6/1989 | Isomura | 292/336.3 |
| 4,889,373 | 12/1989 | Ward et al. | 292/336.3 |
| 4,993,763 | 2/1991 | Tanimoto et al. | 292/336.3 |
| 5,011,202 | 4/1991 | Kato et al. | 292/DIG. 31 |

FOREIGN PATENT DOCUMENTS

| | | | |
|---|---|---|---|
| 2359457 | 2/1978 | France | 292/336.3 |
| 2363060 | 6/1975 | Germany | 292/336.3 |
| 5-321518 | 7/1993 | Japan . | |
| 632123 | 11/1949 | United Kingdom | 292/336.3 |

*Primary Examiner*—Rodney M. Lindsey
*Attorney, Agent, or Firm*—Finnegan, Henderson, Farabow, Garrett, & Dunner, L.L.P.

[57] ABSTRACT

A door locking device for a vehicle includes an inside handle for releasing a door latch of the vehicle; a motion transmit member for transmitting a motion of said inside handle to the door latch; a safety knob interconnected with the inside handle for locking the door latch; and a motion delay mechanism provided between the inside handle and the motion transmit member, wherein the motion delay mechanism do not transmit the motion of the inside handle to the door latch during a first period of the motion of the inside handle and the motion delay mechanism transmit the motion of the inside handle to the door latch during the remaining period of the motion of the inside handle. By pulling the inside handle when the safety knob is in the locked state, the safety knob is unlocked first and, then, the engagement between the door latch and the door striker is released such that these two operation do not interfere with each other thus assuring a precise operation of the door latch.

2 Claims, 4 Drawing Sheets

DOOR LOCKING DEVICE FOR VEHICLE

BACKGROUND OF THE INVENTION

1. Field of the Invention

The present invention relates to a door locking device for a vehicle.

2. Description of the Prior Art

Door of a vehicle is pivotally installed on the vehicle body by means of a door hinge attached on the vehicle and a corresponding hinge attached to the door. A door latch installed on the door is engaged with a door striker attached on the vehicle body to maintain the door closed with respect to the vehicle body, and the door latch is interconnected with door handles.

The door handles consist of an inside handle and an outside handle. A safety knob provided on an inside of the door makes it unable to open the door from outside of the vehicle.

In order to open the door from inside of the vehicle when the safety knob is locked, one must unlock the safety knob first and, then, pull the inside handle. To simplify this two-stepped operation, it is necessary to let the safety knob unlocked automatically by pulling the inside handle without releasing the safety knob separately.

A door locking device with such function is disclosed in a Laid-Open Japanese Patent Application No. 5-321518, the brief composition of which being shown in FIG. 4. Referring to FIG. 4, the inside handle 51 interconnected with the door latch (not shown) by a rod 52 is pivotally installed by a pin 50, and the safety knob 55 interconnected with the door latch by a rod 57 is pivotally installed by a pin 56. One end of a rod 53 is connected with the inside handle 51, and the other end of the rod 53 is engaged with a slot 54 formed on the safety knob 55.

When the inside handle 51 is pulled along the direction A, the rod 53 become pushed along the direction C to turn the safety knob 55 along the direction D and, accordingly, the rod 57 become pulled along the direction E to unlock the door latch, and, simultaneously, the rod 52 become pulled along the direction B to release the engagement between the door latch and the door striker. Thus, it is not necessary to release the safety knob 55 separately to unlock the door latch because unlocking of the door latch and releasing of the engagement between the door latch and the door striker can be simultaneously performed by pulling the inside handle 51.

However, in the above-mentioned door locking device, the operation of unlocking of the door latch by moving the rod 57 interconnected with the safety knob 55 and releasing of the engagement between the door latch and the door striker by moving the rod 52 interconnected with the inside handle 51 are performed simultaneously, not sequentially, and these two operation may interfere with each other such that the operation of the door latch may be paralysed.

SUMMARY OF THE INVENTION

An object of the present invention is to solve the above-mentioned problems by providing a door locking device for a vehicle wherein, as the inside handle is pulled, the door latch is unlocked first and the engagement between the door latch and the door striker is released thereafter.

To accomplish the object, the present invention provides a door locking device for a vehicle comprising: an inside handle installed on an inside of a door of the vehicle for releasing a door latch of the vehicle; a motion transmit means for transmitting a motion of the inside handle to the door latch; a safety knob installed on the inside of the door of the vehicle and interconnected with the inside handle for locking the door latch; and a motion delay means provided between the inside handle and the motion transmit means, wherein the motion delay means do not transmit the motion of the inside handle to the door latch during a first period of the motion of the inside handle and the motion delay means transmit the motion of the inside handle to the door latch during the remaining period of the motion of the inside handle.

In an aspect of the present invention, the motion delay means includes a first slot formed on the motion transmit means in a longitudinal direction thereof, a second slot formed on the inside handle in a direction crossing the first slot, and a connecting member engaged with the first slot and the second slot for connecting the inside handle with the motion transmit means.

DETAILED DESCRIPTION OF THE PREFERRED EMBODIMENT

Below, a preferred embodiment of the present invention is described referring to the attached drawings.

Figure 1:
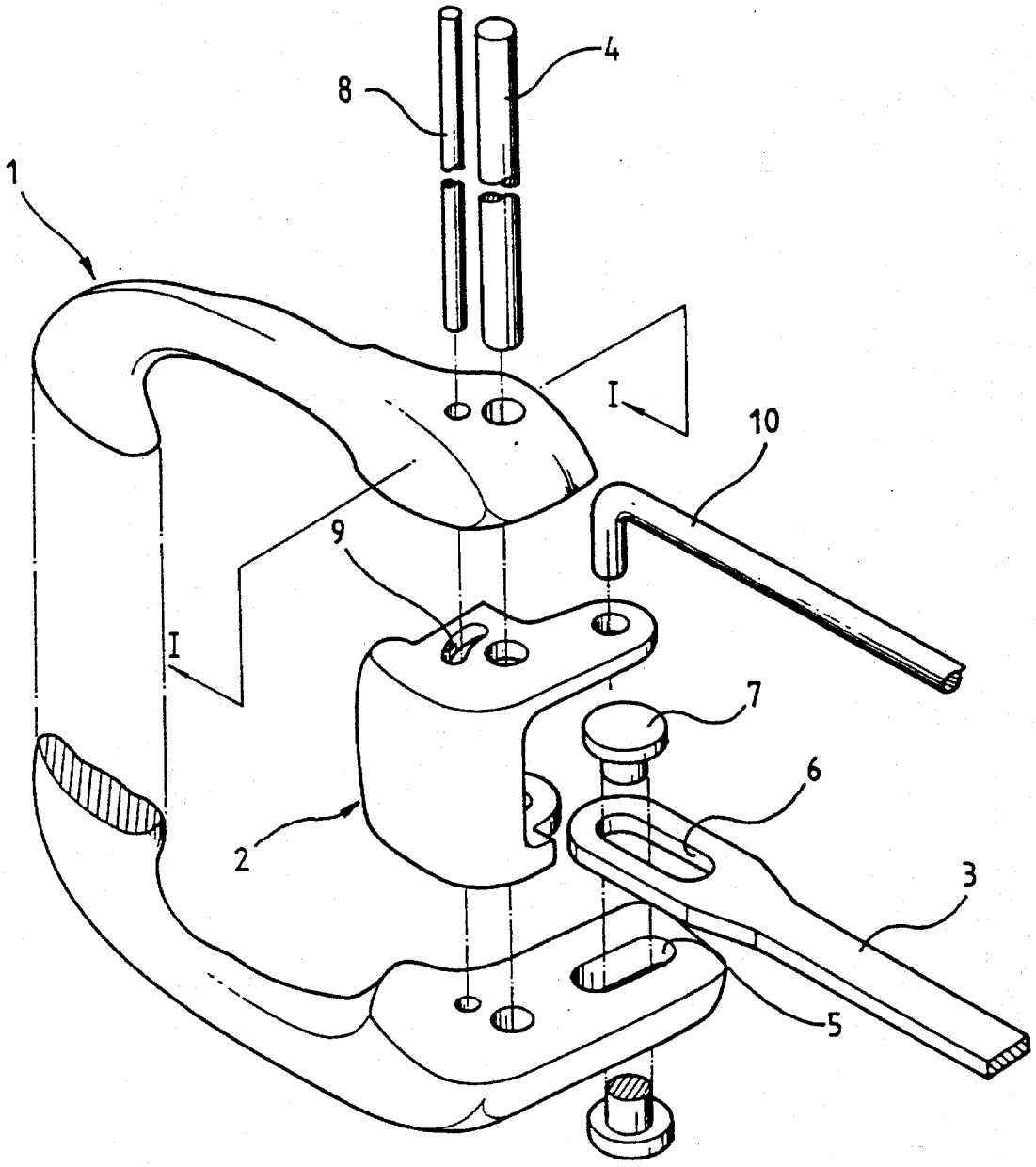
FIG. 1 is an exploded perspective view illustrating a door locking device for a vehicle according to a preferred embodiment of the present invention.
Figure 2:
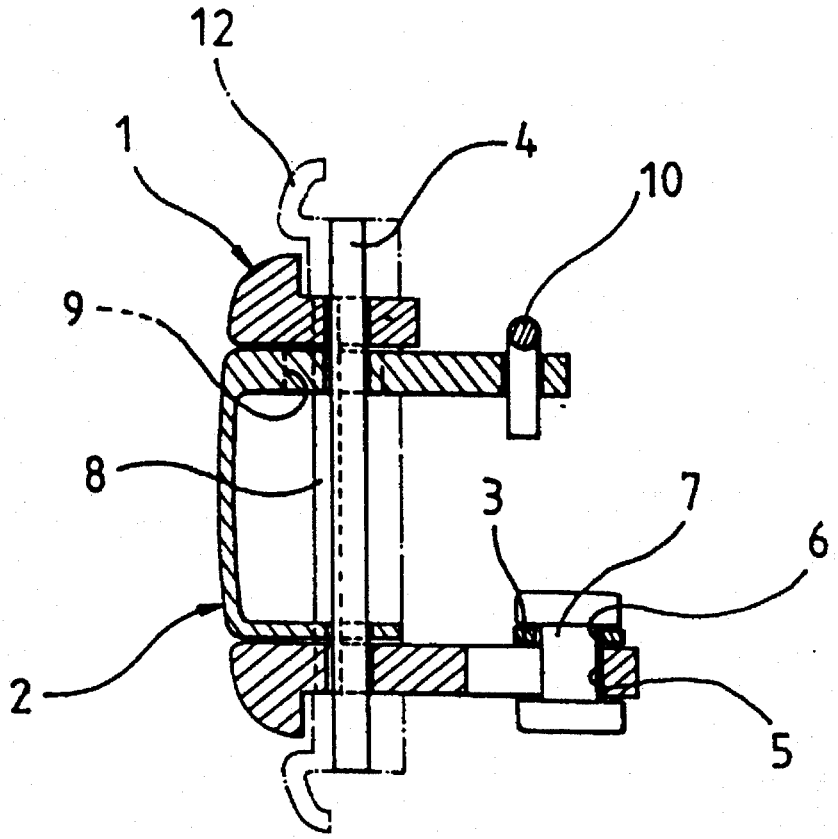
FIG. 2 is a cross section view taken along line I—I in FIG. 1.

Referring to FIGS. 1 and 2, an inside handle 1 and a safety knob 2 are pivotally installed on a door handle housing 12 provided on an inside of a door of a vehicle by means of a pin 4.

The inside handle 1 is interconnected with a door latch (not shown) attached on the door through a first rod 3, and the safety knob 2 is interconnected with the door latch through a second rod 10.

A first slot 6 is formed on the first rod 3 in a longitudinal direction thereof, and a second slot 5 is formed on the inside handle 1 in a direction crossing the first slot 6. The first rod 3 and the inside handle 1 are connected by a pin 7 penetrating through the first slot 6 and the second slot 5. As described later, the first slot 6 functions to transmit a motion of the inside handle 1 to the first rod 3 with a predetermined motion lag, and the second slot 5 allows that the inside handle 1 may be rotated with respect to the first rod 3 such that the first rod 3 can perform a linear reciprocating motion without a rocking motion.

A pin 8 fixed to the inside handle i penetrates an arcuate slot 9 formed around the pin 4. The safety knob 2 may be rotated with respect to the inside handle 1 within an angular range defined by the arcuate slot 9.

The rotation of the inside handle 1 around the pin 4 is converted into a linear motion of the first rod 3 to release the engagement between the door latch and a door striker (not shown) attached on the vehicle body. The rotation of the safety knob 2 around the pin 4 is converted into a linear motion of the second rod 10 to lock or unlock the door latch.

Figure 3A:
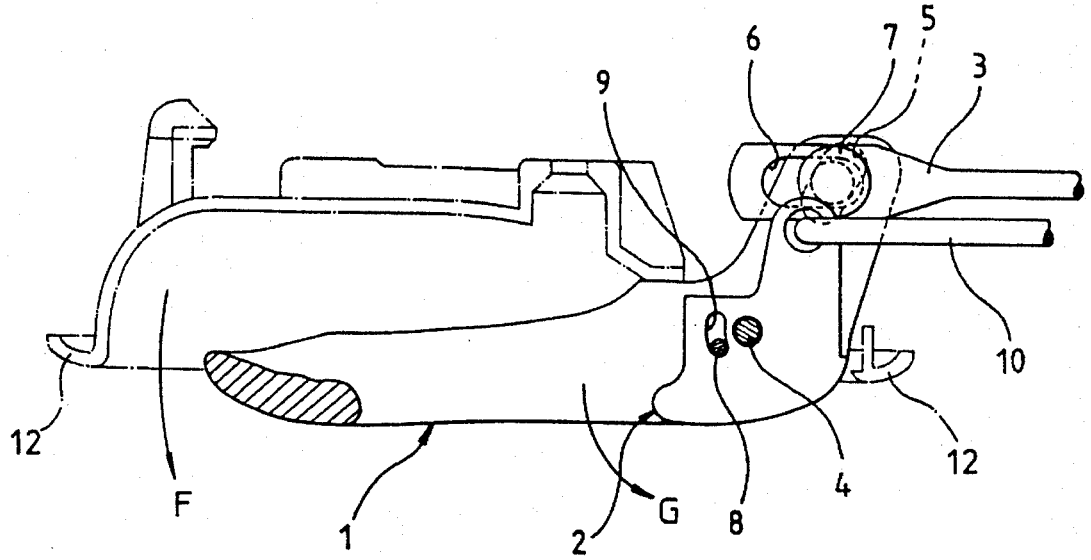
FIG. 3A is a diagrammatic plan view showing a state when a safety knob is locked in the door locking device of FIG. 1.
Figure 3B:
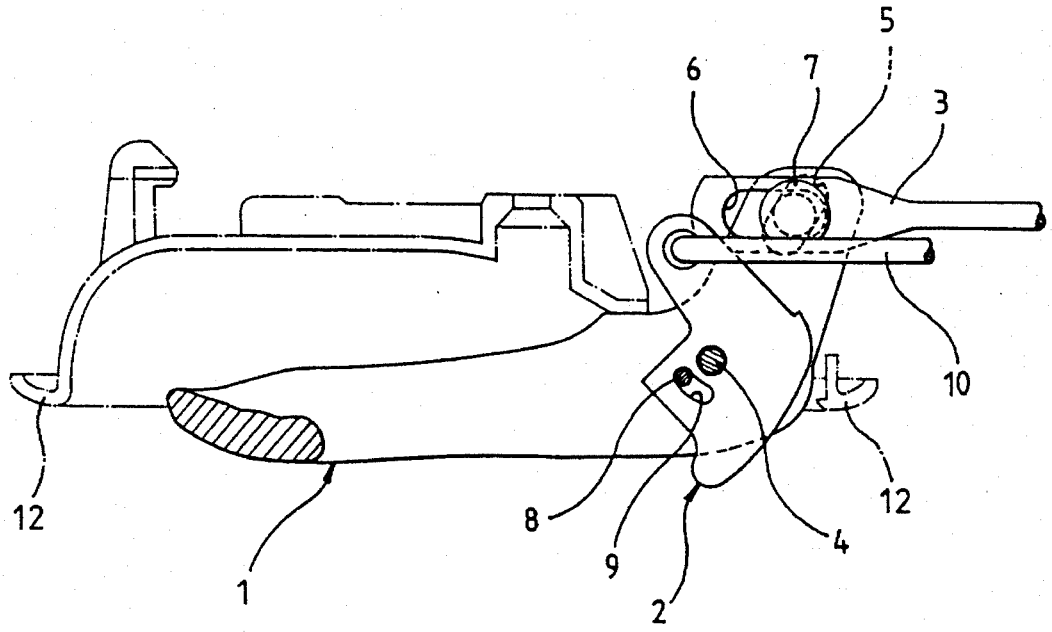
FIG. 3B is a diagrammatic plan view showing a state when the safety knob is unlocked in the door locking device of FIG. 1.
Figure 4:
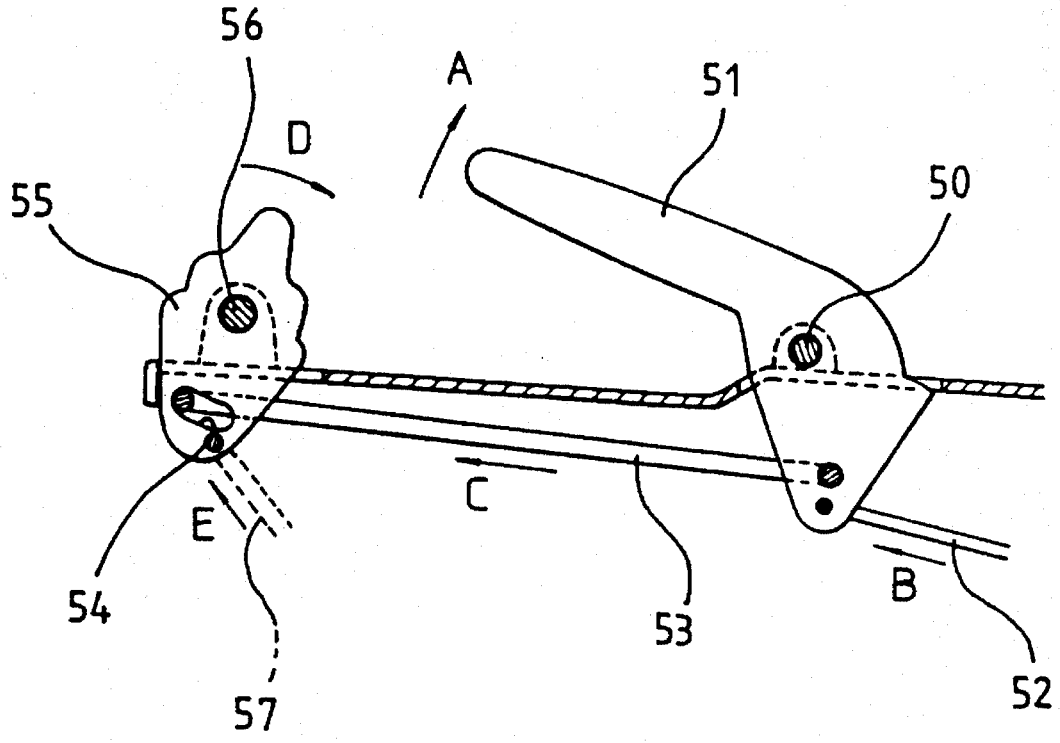
FIG.4 (Prior Art)
FIG. 4 is a diagrammatic plan view showing a conventional door locking device.

FIGS. 3A and 3B shows the safety knob 2 in a locked state and unlocked state, respectively, and, at these state, the door latch (not shown) is pushed into a locked state and pulled into an unlocked state by the second rod 10, respectively. Of course, the engagement between the door latch and the door striker can not be released to open the door by pulling an outside handle (not shown) when the safety knob 2 is in a locked state, while the engagement between the door latch and the door striker can be released to open the door by pulling the outside handle when the safety knob 2 is in an unlocked state.

When the safety knob 2 is in the locked state as shown in FIG. 3A, the pin 7 abuts on a right edge of the first slot 6 and the pin 8 fixed on the inside handle 1 abuts on a lower end edge of the arcuate slot 9 of the safety knob 2. As the inside handle 1 is turned in the direction F, the safety knob 2 pushed by the pin 8 is turned in the direction G and unlocked during a first period of the motion of the inside handle 1 while the first rod 3 is not moved until the pin 7 abuts on a left edge of the first slot 6. The first rod 3 is pulled leftward to release the engagement between the door latch and the door striker during the remaining period of the motion of the inside handle 1, and, then, the door can be opened.

In the door locking device according to the present invention, as the inside handle is pulled when the safety knob is in the locked state, the safety knob is unlocked first and, then, the engagement between the door latch and the door striker is released such that these two operation do not interfere with each other thus assuring a precise operation of the door latch.

What is claimed is:

1. A door locking device for a vehicle comprising:

an inside handle for being installed on an inside of a door of the vehicle for releasing a door latch of the vehicle;

a motion transmit means for transmitting a motion of said inside handle to the door latch;

a safety knob for being installed on the inside of the door of the vehicle and interconnected with said inside handle for locking the door latch; and a motion delay means provided between said inside handle and said motion transmit means, wherein said motion delay means do not transmit the motion of said inside handle to the door latch during a first period of the motion of said inside handle and said motion delay means transmit the motion of said inside handle to the door latch during a remaining period of the motion of said inside handle.

2. A door locking device as claimed in claim 1, wherein said motion delay means includes a first slot formed on said motion transmit means in a longitudinal direction thereof, a second slot formed on said inside handle in a direction crossing said first slot, and a connecting member engaged with said first slot and said second slot for connecting said inside handle with said motion transmit means.

* * * * *